US009867518B1

(12) United States Patent
Miramontes

(10) Patent No.: US 9,867,518 B1
(45) Date of Patent: Jan. 16, 2018

(54) DEVICE FOR WRINGING A MOP AND METHOD OF USE

(71) Applicant: Ivan Miramontes, Fontana, CA (US)

(72) Inventor: Ivan Miramontes, Fontana, CA (US)

( * ) Notice: Subject to any disclaimer, the term of this patent is extended or adjusted under 35 U.S.C. 154(b) by 0 days.

(21) Appl. No.: 15/372,525

(22) Filed: Dec. 8, 2016

(51) Int. Cl.
*F26B 5/08* (2006.01)
*A47L 13/58* (2006.01)

(52) U.S. Cl.
CPC ..... *A47L 13/58* (2013.01)

(58) Field of Classification Search
CPC .. F26B 5/08; F26B 11/02; F26B 17/30; A47L 13/10; A47L 13/58; A47L 13/60; A47G 9/08
USPC ..... 34/398, 90; 4/619; 312/207; 15/119.2
See application file for complete search history.

(56) References Cited

U.S. PATENT DOCUMENTS 336,956 A * 3/1886 Smith ..... B30B 9/067 100/116
1,009,308 A * 11/1911 Hilker ..... A47L 13/59 15/261
2,664,584 A * 1/1954 Twerdahl ..... A47L 13/58 15/260
4,720,879 A * 1/1988 Rabban ..... A47L 13/60 15/262
4,974,281 A * 12/1990 Shaw ..... A47L 13/59 15/260
5,428,860 A * 7/1995 Hurt ..... A47L 13/60 15/260
6,327,740 B1 * 12/2001 Baltazar ..... A47L 13/59 15/261
8,025,347 B1 * 9/2011 Solis ..... A47L 13/51 312/206
8,240,063 B2 * 8/2012 Grimes ..... A47L 13/14 15/119.1
2006/0032080 A1 * 2/2006 Rust ..... A47L 13/58 34/524

FOREIGN PATENT DOCUMENTS

DE 1908928 A1 * 9/1970 ..... A47L 13/146
JP 09024012 A * 1/1997

OTHER PUBLICATIONS

NPL search on google on wall mounted mop buckets dated Nov. 3, 2017.*

* cited by examiner

*Primary Examiner* — Stephen M Gravini
(74) *Attorney, Agent, or Firm* — Ted Masters

(57) ABSTRACT

A device for wringing a mop having a plurality of strings connected to a handle and a tailband connected to the strings, includes a bucket having a base connected to a wall. A wringer inwardly projects from the wall. The wringer is shaped and dimensioned to pass through the strings of the mop, so that when the mop is twisted the wringer captively engages the strings to effect a wringing action. In an embodiment, the wringer is a rod. In another embodiment, a friction-enhancing material is disposed on the bottom of the base. The friction-enhancing material prevents the bucket from moving as the mop is twisted and wrung out.

20 Claims, 10 Drawing Sheets

FIG. 12
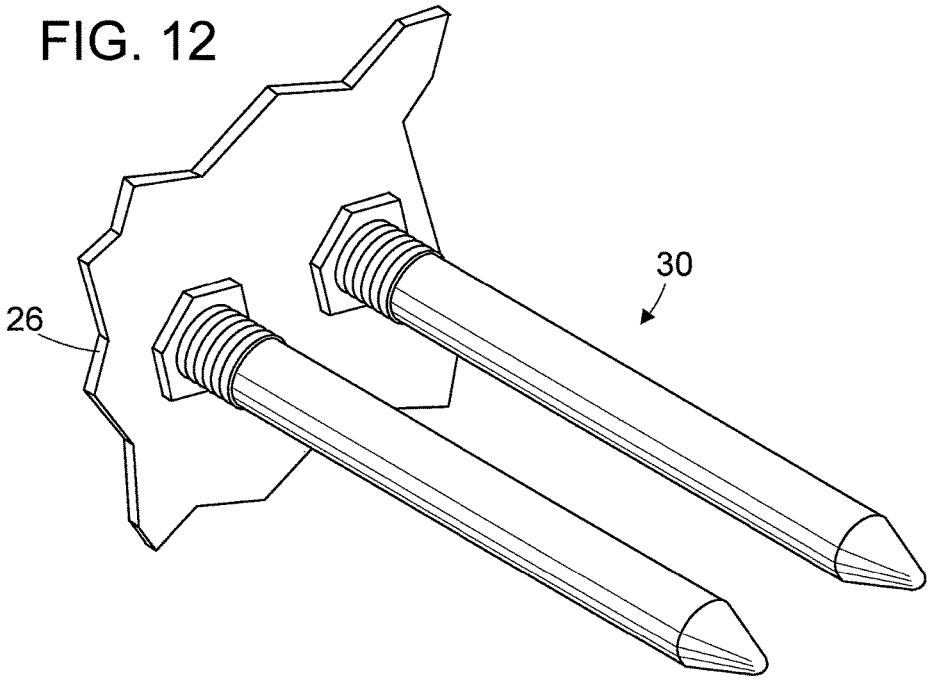
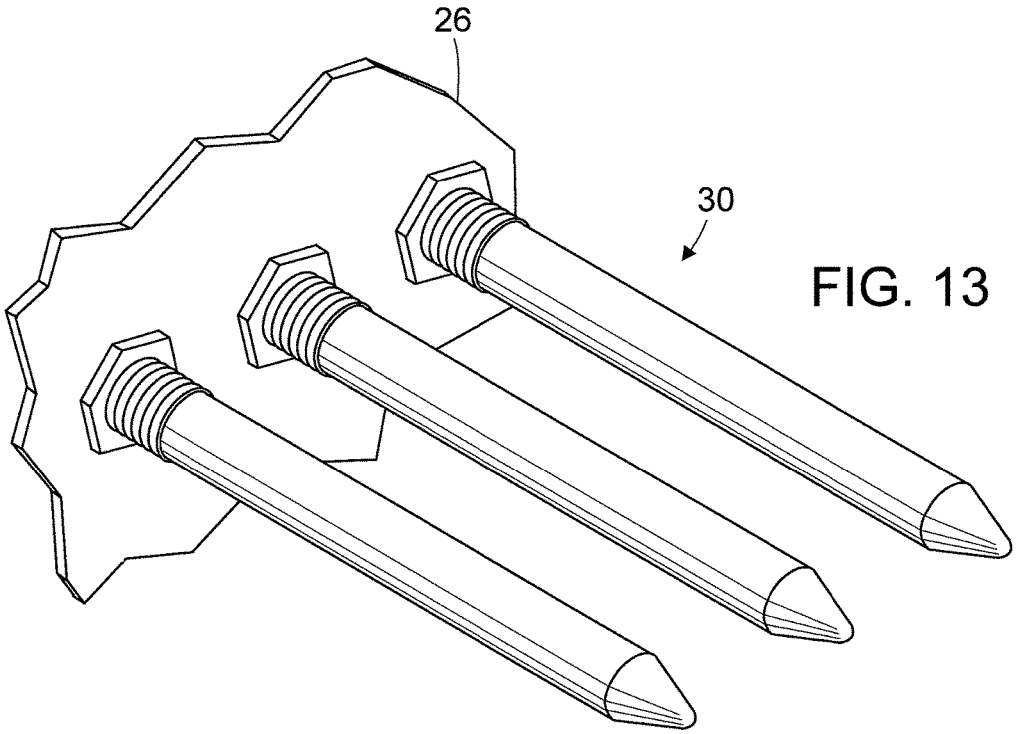
FIG. 13

DEVICE FOR WRINGING A MOP AND METHOD OF USE

CROSS REFERENCE TO RELATED APPLICATION

None

TECHNICAL FIELD

The present invention pertains generally to cleaning, and more particularly to a device and method for wringing a mop.

BACKGROUND OF THE INVENTION

A mop is a common utensil used for cleaning. One type of mop includes a plurality of absorbent strings, such as yarn, cloth, sponge, or the like, which are bundled and attached to an elongated handle. The strings of the mop soak up liquid, for cleaning floors and other surfaces. Mops are often used in conjunction with a cleaning liquid which is disposed in a bucket.

A wide variety of devices have been invented for wringing liquid from the strings of a mop by twisting, squeezing, spinning and the like. Most such wringers are quite complex, include a variety of components, have many moving parts, and require significant manufacturing and assembly efforts. Moreover, some spin dry wringers are made of hard plastic wherein the moving parts are prone to sun damage and/or breakage. Also, in some cases the wringing results are not satisfactory, and the strings of the mop are not completely purged of liquid.

BRIEF SUMMARY OF THE INVENTION

The present invention is directed to a device for wringing a mop. The device includes a wringer, such as at least one rod, which inwardly projects from the wall of a bucket. The wringer engages the strings of the mop, and the handle of the mop is then twisted. The twisting causes the strings to tighten around the wringer, thereby forcing a cleaning liquid such as water from the strings. The device is effective, has no moving parts, is simple, is durable, and has a low manufacture and assembly cost.

In accordance with an embodiment, a device for wringing a mop, the mop having a plurality of strings connected to a handle, a tailband connected to the strings of the mop, the device includes a bucket which has a base connected to a wall. A wringer inwardly projects from the wall. The wringer is shaped and dimensioned to pass through the strings of the mop above the tailband.

In accordance with another embodiment, the bucket has a rim. The wringer is disposed closer to the rim than to the base.

In accordance with another embodiment, the wringer is bolted to the wall.

In accordance with another embodiment, the wringer includes at least one rod.

In accordance with another embodiment, the wringer has a length which allows it to pass completely through the strings of the mop.

In accordance with another embodiment, the wringer includes spaced apart grooves.

In accordance with another embodiment, the base includes a bottom. A friction-enhancing material is disposed on the bottom of the base.

Other embodiments, in addition to the embodiments enumerated above, will become apparent from the following detailed description, taken in conjunction with the accompanying drawings, which illustrate, by way of example, the principles of the device and method of use.

BRIEF DESCRIPTION OF THE DRAWINGS

FIG. 12 is an enlarged fragmented perspective view of a wringer which includes a plurality of rods; and, FIG. 13 is an enlarged fragmented perspective view of another wringer which includes a plurality of rods.

DETAILED DESCRIPTION OF THE INVENTION

Figure 1:
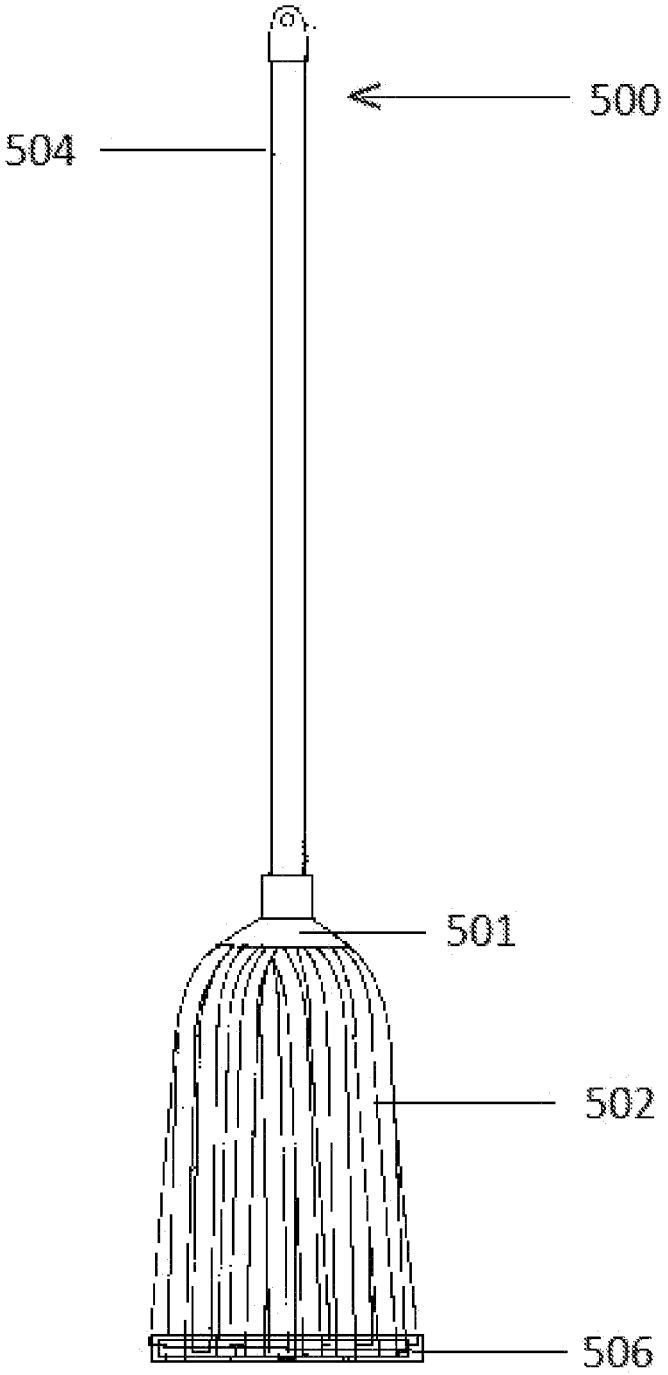
FIG. 1 PRIOR ART
FIG. 1 is an enlarged front elevation view of a prior art mop.

Referring initially to FIG. 1 there is illustrated an enlarged front elevation view of a prior art mop, generally designated as 500. Mop 500 includes plurality of strings 502 which are connected to a handle 504 by a connector 501. In the shown embodiment connector 501 is circular so that strings 502 are distributed in a circle around handle 504, and as such mop 500 appears the same if it is rotated 90 degrees. Strings 502 can be made from cloth, yarn, a sponge, or other absorbent material. A tailband 506 is connected to strings 502, and holds strings 502 together to provide better mop coverage.

Figure 2:
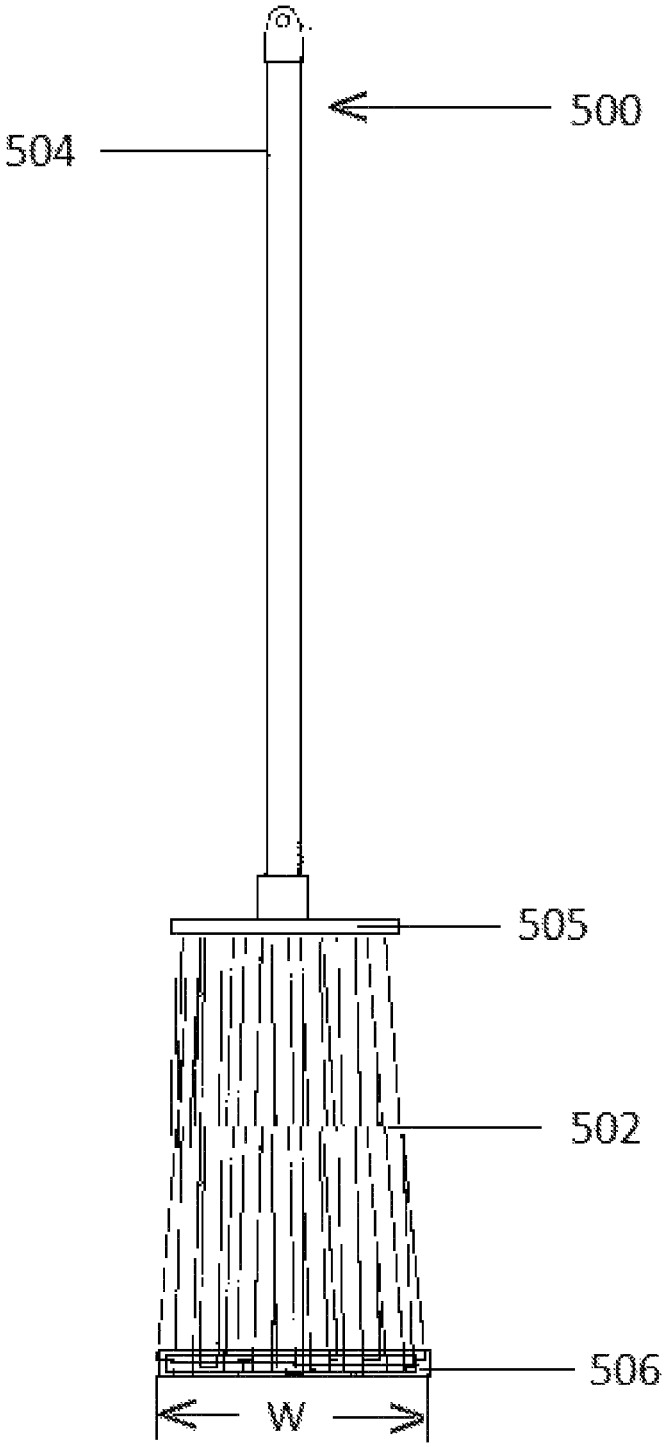
FIG. 2 PRIOR ART
FIG. 2 is an enlarged front elevation view of a second embodiment prior art mop.
Figure 3:
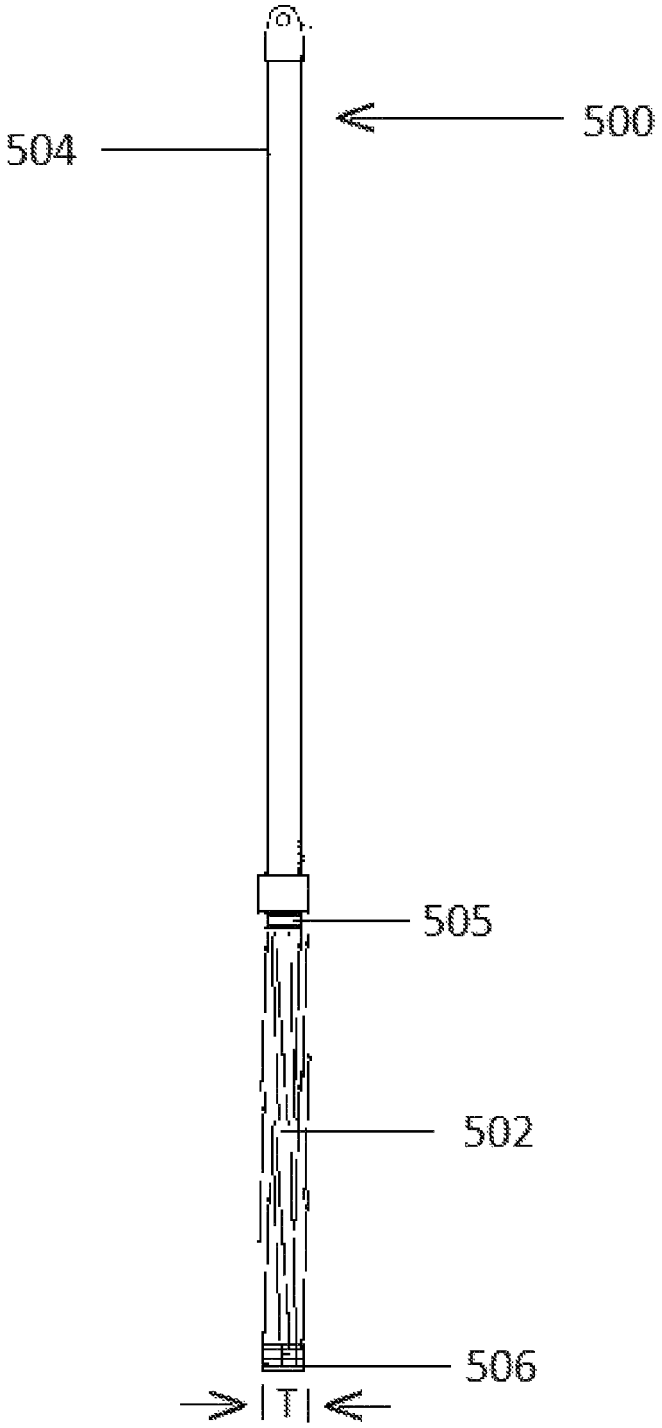
FIG. 3 PRIOR ART
FIG. 3 is an enlarged side elevation view of the second embodiment prior art mop.

Referring to FIGS. 2 and 3, there are illustrated enlarged front elevation and side elevation views respectively of a second embodiment prior art mop, also generally designated as 500. Mop 500 includes plurality of strings 502 which are connected to a handle 504 by a connector 505. In this embodiment connector 505 is a spreader which spreads the top of strings 502 causing strings 502 to have a width W. As is shown in FIG. 3, because of spreader 505, mop 500 has a thickness T which is less than width W. Strings 502 can be made from cloth, yarn, a sponge, or other absorbent material. A tailband 506 is connected to strings 502, and holds strings 502 together to provide better mop coverage.

Figure 4:
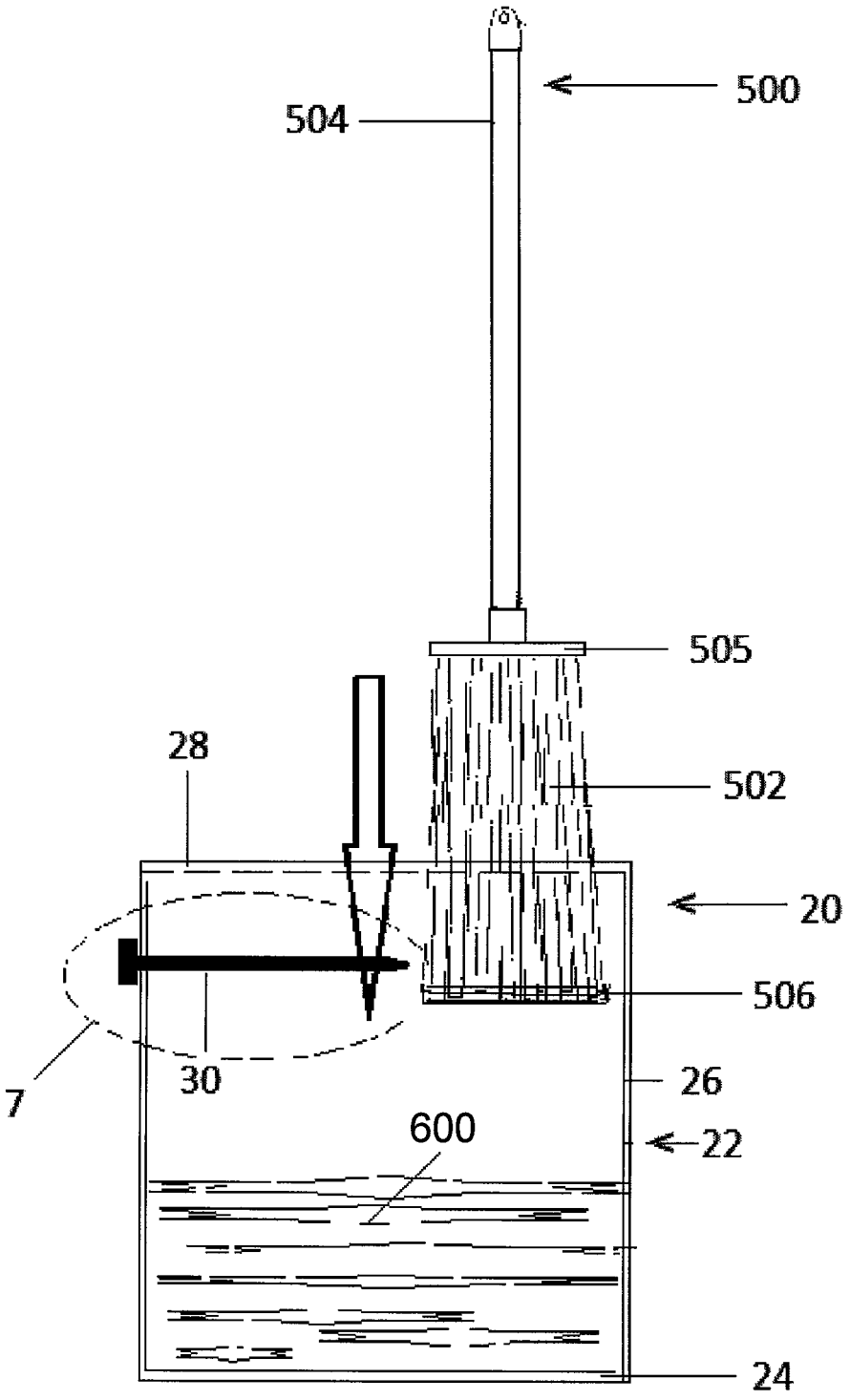
FIG. 4 is a front elevation cutaway view of the mop and a device for wringing the mop.

FIG. 4 is a front elevation cutaway view of mop 500 and a device for wringing mop 500, the device generally designated as 20. While FIG. 4 depicts the spread mop 500 of FIGS. 2 and 3, it may be appreciated that the principles of the present invention can also be applied to the circular mop 500 of FIG. 1. Device 20 includes a bucket 22 having a base 24 connected to an upstanding wall 26 which has an upper rim 28. As used herein the term bucket 22 includes any container which has an open top and which is capable of holding a cleaning liquid 600 such as water, water combined with a cleaning agent (e.g. soap), or other cleaning liquid. Bucket 22 can be of any useful shape. In the shown embodiment bucket 22 is circular.

A wringer 30 inwardly projecting from wall 26 toward the center of bucket 22. In the shown embodiment wringer 30 is directly connected to wall 26 by bolting (refer also to FIGS. 7 and 10 and the associated discussions). Wringer 30 is shaped and dimensioned to pass through the strings 502 of the mop 500. In the shown embodiment, wringer 30 includes at least one rod (refer also to FIGS. 7, 8, 10, and 11). In an embodiment wringer 30 has a tapered end which allows it to pass through strings 502 more easily. In another embodiment to effect more complete wringing, wringer 30 has a length which allows it to pass completely through all of the strings 502 of the mop 500. That is, wringer 30 enters one side of strings 502 and emerges on the other side of strings 502 (refer to FIG. 5). It is noted that wringer 30 is disposed closer to rim 28 than to base 24. This is so mop 500 can be wrung out without contacting cleaning liquid 600. In FIG. 4, mop 500 is being moved downward so that strings 502 will be immerse (dipped) in cleaning liquid 600.

Figure 5:
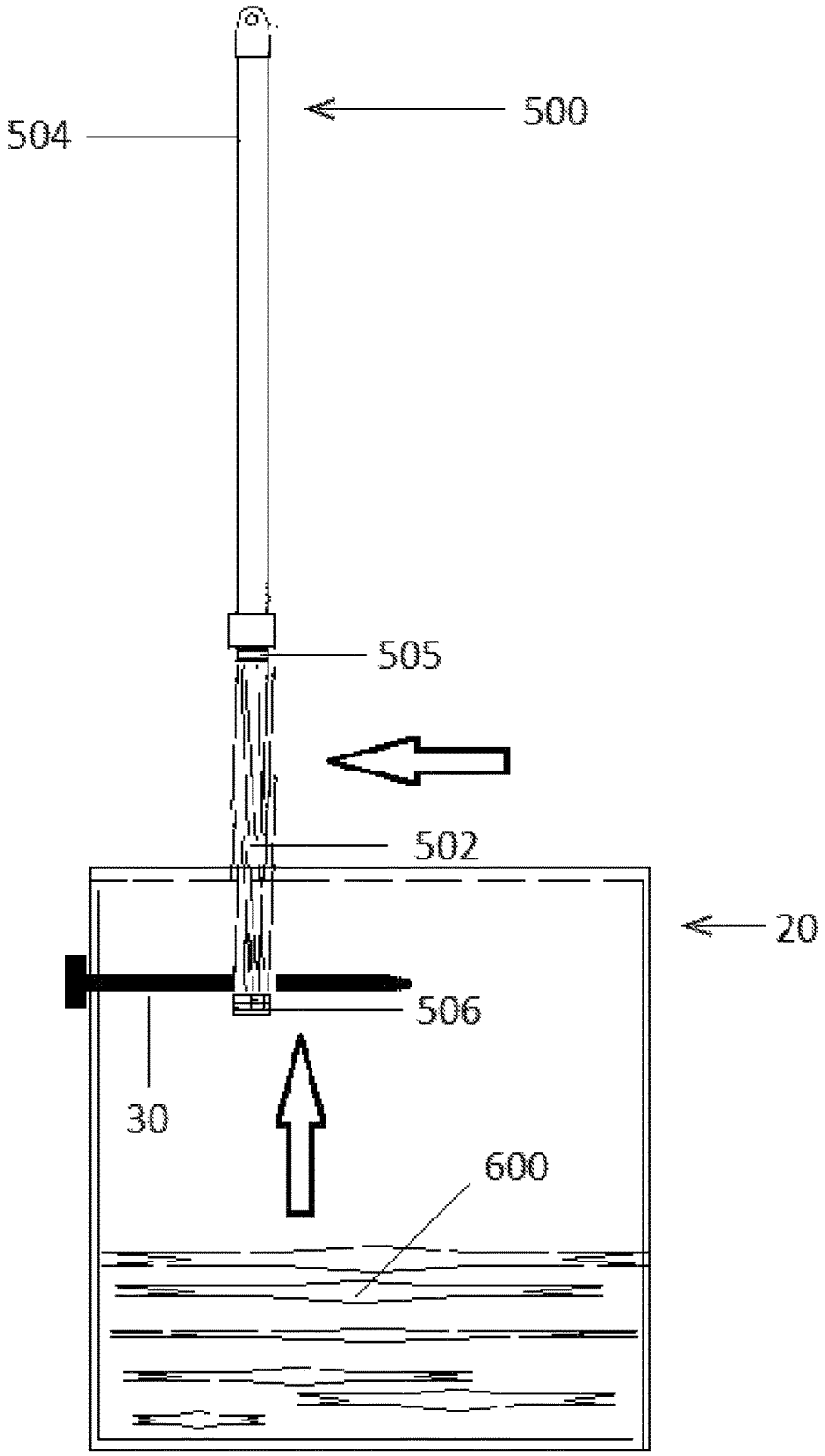
FIG. 5 is a front elevation cutaway view of the mop positioned in the device.

FIG. 5 is a front elevation cutaway view of mop 500 positioned in device 20. After strings 502 have been dipped into cleaning liquid 600, mop 500 is raised so that it aligns with wringer 30. Wringer 30 is shaped and dimensioned to pass through the strings 502 of the mop 500 above the tailband 506. Mop 500 is vertically positioned so that tailband 506 is below wringer 30. Mop 500 is then moved toward wringer 30 (to the left as shown) so that wringer 30 passes through strings 502 above tailband 506. It is noted that wringer 30 is disposed between tailband 506 and upper rim 28. This is so that when mop 500 is wrung, tailband 506 will prevent strings 502 from disengaging from wringer 30.

Figure 6:
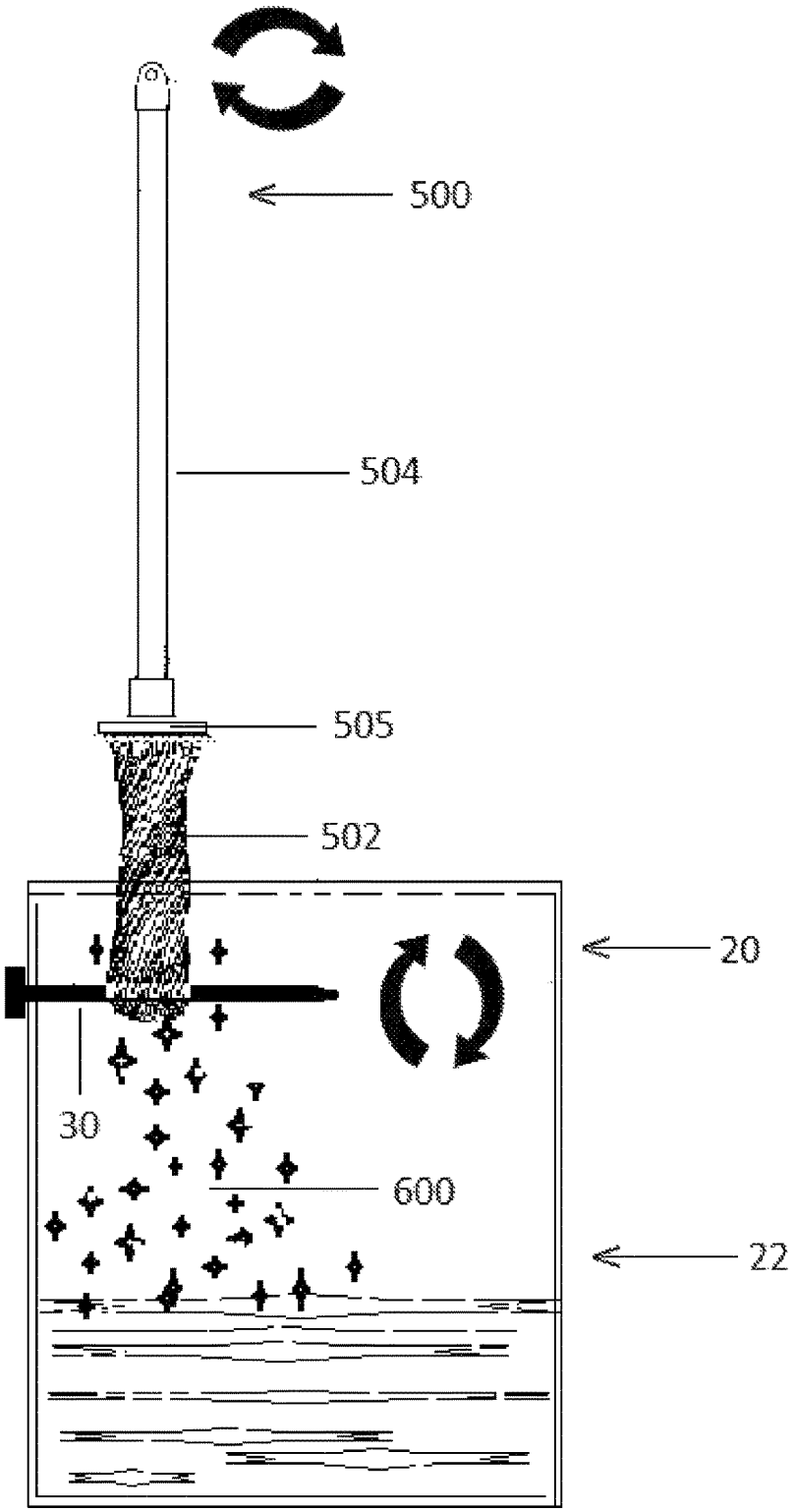
FIG. 6 is a front elevation cutaway view of the strings of the mop being wrung by the device.

FIG. 6 is a front elevation cutaway view of strings 502 of mop 500 being wrung by device 20. Wringer 30 has been passed through strings 502 (refer to FIG. 5), and mop 500 is twisted tight by turning handle 504. Wringer 30 captively engages and wrings strings 502, and the wringing action removes cleaning fluid 600 from strings 502, which falls into bucket 22. In an embodiment, after wringer 30 is passed through strings 502, and before twisting, mop 500 is pulled up so that wringer 30 is adjacent tailband 506. During wringing, tailband 506 prevents strings 502 from disengaging from wringer 30. After strings 502 are purged drip-free of cleaning liquid 600, mop 500 is twisted in the opposite direction and strings 502 are removed (pulled off of) from wringer 30. It is noted that mop 500 has a width W (refer to FIG. 2). Before passing wringer 30 through strings 502, mop 500 is turned so that width W is perpendicular to the wringer 30. For spread mops 500 this simplifies the process of passing wringer 30 through strings 502.

Figure 7:
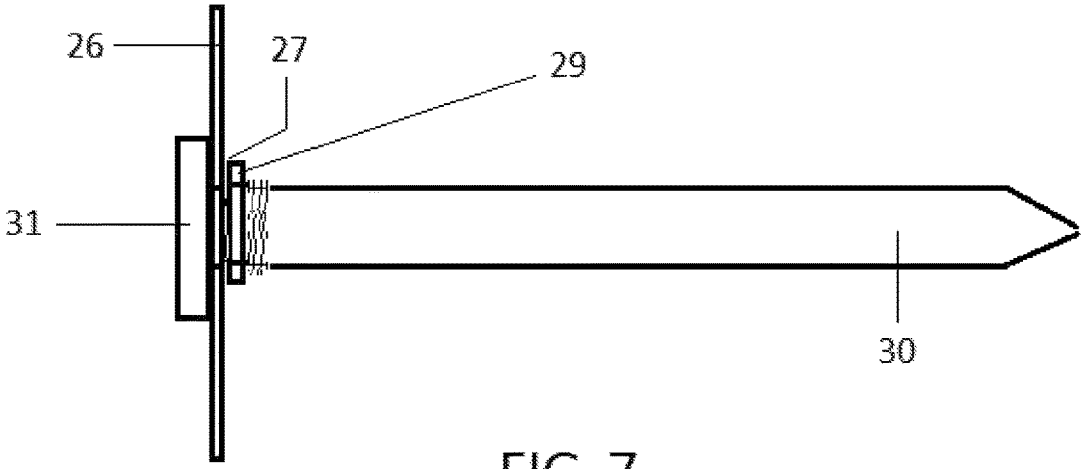
FIG. 7 is an enlarged view of area 7 of FIG. 4.
Figure 10:
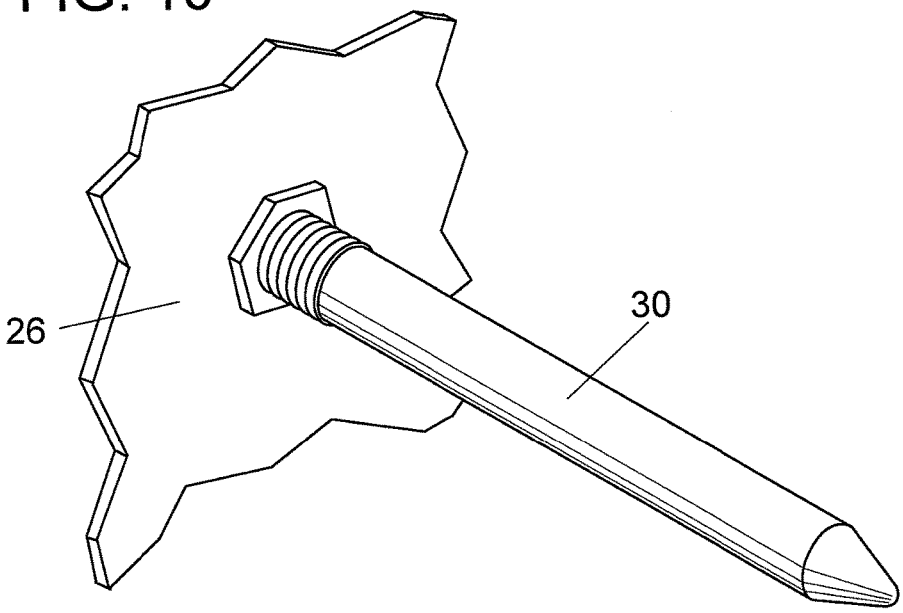
FIG. 10 is an enlarged fragmented perspective view of the wringer connected to the wall of the bucket.

FIG. 7 is an enlarged view of area 7 of FIG. 4, showing wall 26 and wringer 30. In the shown embodiment, wringer 30 comprises a partially threaded rod having a head 31. Wringer 30 is inserted through a hole 27 in upstanding wall 26. A nut 29 firmly connects wringer 30 to wall 26. However it may be appreciated that wringer 30 could be connected to the bucket 22 by other means such as welding, removably connected by clamping or snapping on, etc. FIG. 10 shows a perspective view of wringer 30 and wall 26.

Figure 8:
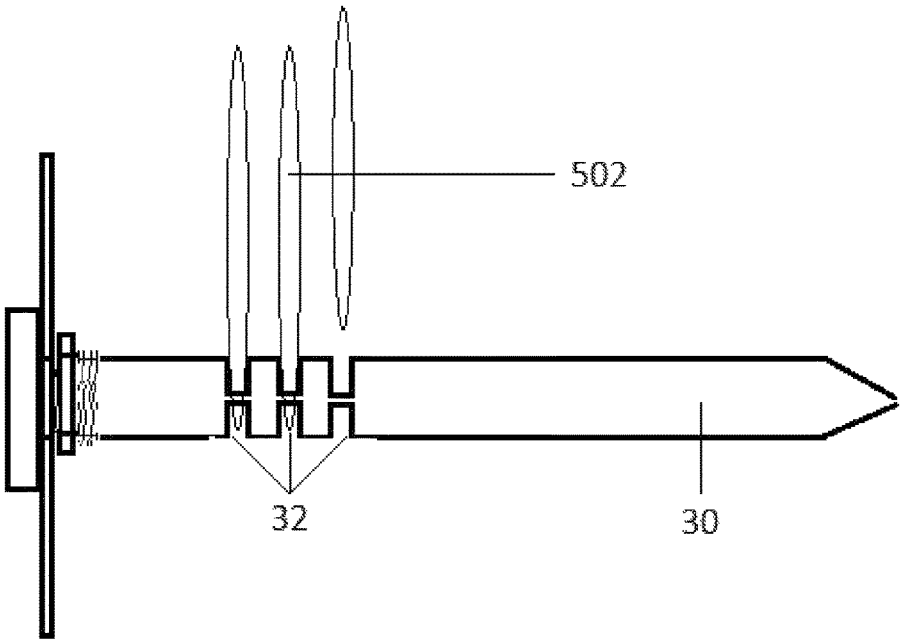
FIG. 8 is an enlarged view of a wringer having grooves.

FIG. 8 is an enlarged side elevation view of a wringer 30 having parallel spaced-apart grooves 32. Mop strings 502 engage grooves 32 resulting in a tighter grip when mop 500 is twisted (refer to FIG. 6).

Figure 9:
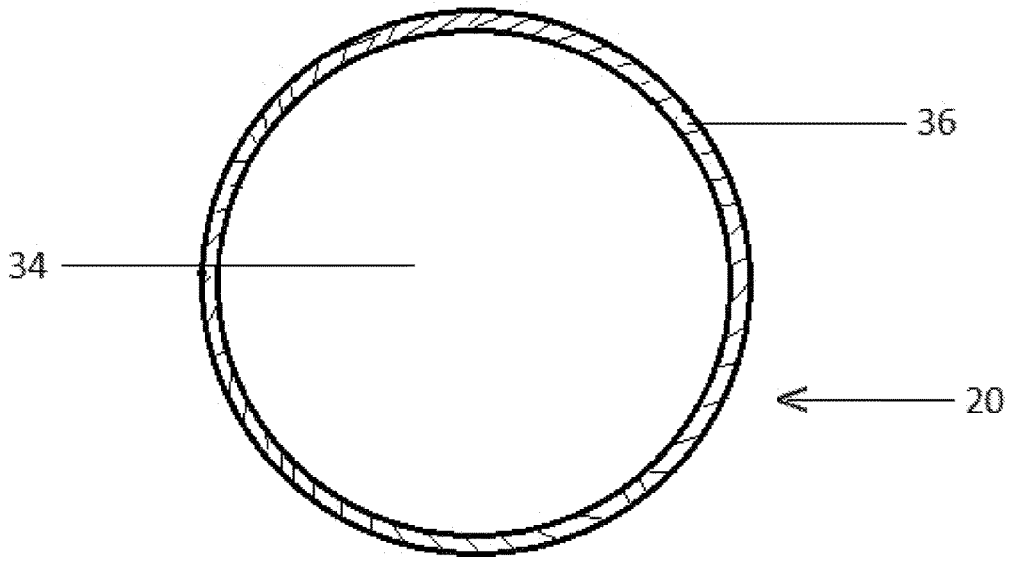
FIG. 9 is a bottom view of a bucket.

FIG. 9 is an enlarged bottom view of bucket 22. Base 24 of bucket 22 has a bottom 34. A friction-enhancing material 36 (such as rubber, a polymer, or the like) is disposed on bottom 34 of base 24. In the shown embodiment, bottom 34 includes a bottom rim. Friction-enhancing material 36 is a circular member having a groove which fits over the bottom rim of base 24. Friction-enhancing material 36 gives bucket 22 a more stable grip on a floor or other support surface, and prevents bucket 22 from rotating or otherwise moving. This is particularly useful when mop 500 is being twisted (refer to FIG. 6).

Figure 11:
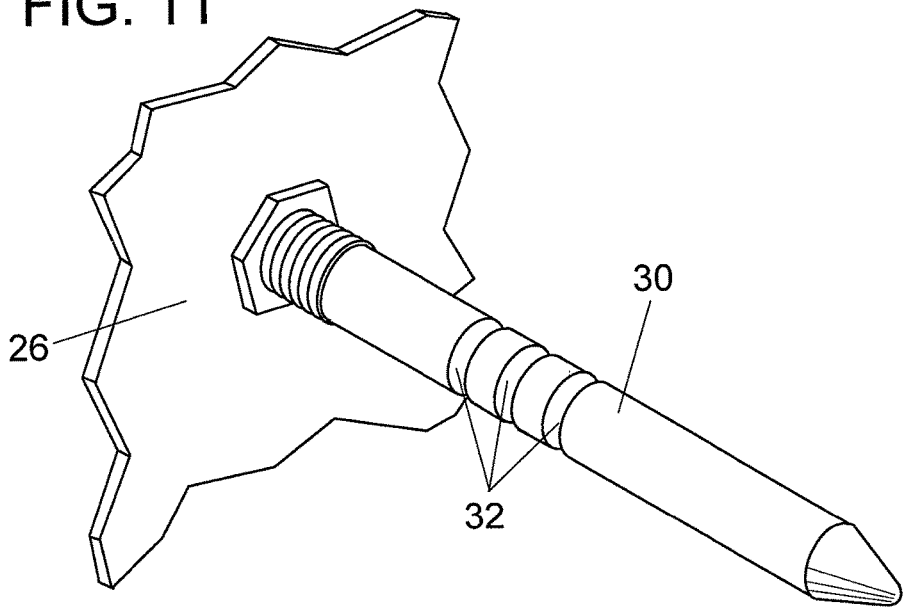
FIG. 11 is an enlarged fragmented perspective view of a wringer having grooves connected to the wall of the bucket.

FIG. 10 is an enlarged fragmented perspective view of wringer 30 connected to wall 26 of bucket 22. And, FIG. 11 is an enlarged fragmented perspective view of a wringer 30 having grooves 32 connected to the wall 26 of bucket 22 (refer to FIG. 8).

FIG. 12 is an enlarged fragmented perspective view of a wringer 30 which includes a plurality of rods (two in the shown embodiment) connected to upstanding wall 26. Multiple rods can increase contact with strings 502 and result in more effective wringing.

FIG. 13 is an enlarged fragmented perspective view of another wringer 30 which includes a plurality of rods (three in the shown embodiment) connected to upstanding wall 26.

It may be appreciated that mop 500 can be combined with device 20 to form a mopping system.

In terms of use, a method for mopping, includes; (refer to FIGS. 1-13)

(a) providing a mop 500 having a plurality of strings 502 connected to a handle 504, a tailband 506 connected to the strings 502;

(b) providing a device 20 for wringing the mop 500, including:

a bucket 22 having a base 24 connected to a wall 26;

the bucket 22 containing a cleaning liquid 600;

a wringer 30 inwardly projecting from the wall 26;

the wringer 30 shaped and dimensioned to pass through the strings 502 of the mop 500 above the tailband 506;

(c) dipping the strings 502 of the mop 500 into the cleaning liquid 600;

(d) positioning the strings 502 of the mop 500 so that the wringer 30 is above the tailband 506;

(e) passing the wringer 30 through the strings 502 of the mop 500; and, (f) twisting the handle 504 of the mop 500, wherein the wringer 30 engages the strings 502 and wrings the cleaning liquid 600 from the strings 502.

The method further including:

in (b), the bucket 22 having a rim 28, and the wringer 30 disposed closer to the rim 28 than to the base 24.

The method further including:

in (a), the mop 500 having a width W, and, before (e), turning the mop 500 so that the width W is perpendicular to the wringer 30.

The method further including:

in (b), the wringer 30 having a length which allows it to pass completely through the strings 502 of the mop 500; and, in (e), passing winger 30 completely through the strings 502 of the mop 500.

The method further including:

after (e) and before (f), pulling the mop 500 up so that the wringer 30 is adjacent the tailband 506.

The method further including:

in (b), a friction-enhancing material 36 disposed on the bottom 34 of the base 24; and, during (f), the friction-enhancing material 36 preventing the bucket 22 from moving.

Note: Unless specifically otherwise stated, and as applicable, the order of performance of the above cited method steps can be changed.

The embodiments of the device and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the device and method should be construed as limiting the invention to a particular embodiment or combination of embodiments. The scope of the invention is defined by the appended claims.

I claim:

1. A device for wringing a mop, the mop having a plurality of strings connected to a handle, a tailband connected to the strings of the mop, the device comprising:

a bucket having a base connected to a wall;

a wringer inwardly projecting from said wall; and, said wringer shaped and dimensioned to pass through the strings of the mop above the tailband.

2. The device according to claim 1, further including:

said bucket having a rim; and, said wringer disposed closer to said rim than to said base.

3. The device according to claim 1, further including:

said wringer being bolted to said wall.

4. The device according to claim 1, further including:

said wringer including at least one rod.

5. The device according to claim 1, further including:

said wringer having a length which allows it to pass completely through the strings of the mop.

6. The device according to claim 1, further including:

said wringer including spaced apart grooves.

7. The device according to claim 1, further including:

said base including a bottom; and, a friction-enhancing material disposed on said bottom of said base.

8. The device according to claim 1, further including:

said bucket having a rim;

said wringer disposed closer to said rim than to said base;

said wringer including at least one rod;

said wringer having a length which allows it to pass completely through the strings of the mop;

said base including a bottom; and, a friction-enhancing material disposed on said bottom of said base.

9. A mopping system, comprising:

a mop having a plurality of strings connected to a handle, a tailband connected to the strings of the mop;

a device for wringing said mop, including;

a bucket having a base connected to a wall;

a wringer inwardly projecting from said wall; and, said wringer shaped and dimensioned to pass through said strings of said mop above said tailband.

10. The mopping system according to claim 9, further including:

said wringer being bolted to said wall.

11. The mopping system according to claim 9, further including:

said wringer including at least one rod.

12. The mopping system according to claim 9, further including:

said wringer having a length which allows it to pass completely through said strings of said mop.

13. The mopping system according to claim 9, further including:

said wringer including spaced apart grooves.

14. The mopping system according to claim 9, further including:

said base including a bottom; and, a friction-enhancing material disposed on said bottom of said base.

15. A method for mopping, comprising:

(a) providing a mop having a plurality of strings connected to a handle, a tailband connected to said strings;

(b) providing a device for wringing said mop, including:

a bucket having a base connected to a wall;

said bucket containing a cleaning liquid;

a wringer inwardly projecting from said wall;

said wringer shaped and dimensioned to pass through said strings of said mop above said tailband;

(c) dipping said strings of said mop into said cleaning liquid;

(d) positioning said strings of said mop so that said wringer is above said tailband;

(e) passing said wringer through said strings of said mop; and, (f) twisting said handle of said mop, wherein said wringer engages said strings and wrings said cleaning liquid from said strings.

16. The method of claim 15, further including:

in (b), said bucket having a rim, and said wringer disposed closer to said rim than to said base.

17. The method of claim 15, further including:

in (a), said mop having a width; and, before (e), turning said mop so that said width is perpendicular to said wringer.

18. The method of claim 15, further including:

in (b), said wringer having a length which allows it to pass completely through said strings of said mop; and, in (e), passing said winger completely through said strings of said mop.

19. The method of claim 15, further including:

after (e) and before (f), pulling said mop up so that said wringer is adjacent said tailband.

20. The method of claim 15, further including:

in (b), a friction-enhancing material disposed on said bottom of said base; and, during (f), said friction-enhancing material preventing said bucket from moving.

* * * * *